US012478243B1

(12) United States Patent
Kremmel et al.

(10) Patent No.: US 12,478,243 B1
(45) Date of Patent: Nov. 25, 2025

(54) MOLDED PULP PACKAGING INSERT FOR A DISHWASHER APPLIANCE

(71) Applicant: Haier US Appliance Solutions, Inc., Wilmington, DE (US)

(72) Inventors: Aldo Vincent Kremmel, Palmyra, IN (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/777,867

(22) Filed: Jul. 19, 2024

(51) Int. Cl.
*A47L 15/50* (2006.01)

(52) U.S. Cl.
CPC ..... *A47L 15/505* (2013.01)

(58) Field of Classification Search
CPC ..... B65D 81/053; B65D 81/054; A47L 15/50; A47L 15/505
See application file for complete search history.

(56) References Cited

U.S. PATENT DOCUMENTS 2,266,181 A * 12/1941 Epps ..... B65D 71/04 206/544
4,120,441 A * 10/1978 Hurley ..... B65D 5/5088 217/69
4,244,471 A * 1/1981 Plante ..... B65D 81/054 53/399
4,742,916 A * 5/1988 Galea ..... B65D 81/054 217/53
5,769,233 A * 6/1998 Fredriks ..... B65D 81/054 206/320
6,123,199 A * 9/2000 Madsen ..... D21J 7/00 206/586
7,318,526 B2 * 1/2008 Seelye ..... B65D 81/054 52/287.1
8,757,384 B2 * 6/2014 Ooi ..... B65D 5/5088 206/521
9,771,728 B2 * 9/2017 Gilpin ..... E02D 27/00
9,856,608 B1 * 1/2018 Chung ..... B65D 25/14
11,021,093 B2 * 6/2021 Jaeckel ..... B60N 3/103
12,084,254 B2 * 9/2024 Buhl ..... B65D 5/5035
2003/0080023 A1 * 5/2003 Slot ..... B65D 81/133 206/588
2004/0159620 A1 * 8/2004 Ross ..... A47G 19/30 211/85.4

(Continued)

FOREIGN PATENT DOCUMENTS

CN 211674100 U 10/2020
CN 111023684 B 7/2021

(Continued)

*Primary Examiner* — Patrick D Hawn
(74) *Attorney, Agent, or Firm* — Dority & Manning, P.A.

(57) ABSTRACT

A dishwasher appliance includes a tub defining a receiving chamber; at least one rack assembly removably positioned within the receiving chamber, the at least one rack assembly including a wire frame member; and a rack piece removably coupled to the at least one rack assembly. The rack piece includes a first arm positioned along a first lateral side of the at least one rack assembly; and a second arm positioned along a second lateral side of the at least one rack assembly opposite the first lateral side, wherein the rack piece is formed from a recyclable molded pulp material.

12 Claims, 5 Drawing Sheets

(56) References Cited

U.S. PATENT DOCUMENTS

| | | | | |
|---|---|---|---|---|
| 2012/0118767 | A1* | 5/2012 | Koett | B63B 32/57 206/586 |
| 2016/0221742 | A1* | 8/2016 | Edwards | B65C 3/08 |
| 2018/0030659 | A1* | 2/2018 | Chung | D21H 11/12 |
| 2023/0192383 | A1* | 6/2023 | Buhl | B65D 81/107 206/521 |

FOREIGN PATENT DOCUMENTS

| | | | | | |
|---|---|---|---|---|---|
| JP | 2015061955 | A | * | 4/2015 | |
| KR | 20050123193 | A | | 12/2005 | |
| KR | 20090003884 | U | * | 4/2009 | A47L 15/50 |
| KR | 20170137473 | A | * | 12/2017 | A47L 15/501 |

* cited by examiner

MOLDED PULP PACKAGING INSERT FOR A DISHWASHER APPLIANCE

FIELD OF THE INVENTION

The present subject matter relates generally to domestic appliances, and more particularly to packing materials for dishwasher appliances.

BACKGROUND OF THE INVENTION

Dishwasher appliances generally include a tub defining a receive space, a door to open and close the tub, and one or more racks removable positioned within the receiving space. The racks may include rollers which selectively roll along tracks attached to an interior surface of the tub such that a user may selectively remove the racks by rolling them outward via the rollers and racks. During packing and transport of the dishwasher appliance, the racks should be secured or locked into place to avoid movement which may cause damage to the appliance or one or more of attachments included therein.

Conventional dishwasher appliance may include blocks, ties, padding, or other securing features to ensure the racks stay stabilized during transit. However, existing methods have certain drawbacks. For instance, many padding or packaging materials are made from non-recyclable foam such as polystyrene foam, expandable polystyrene foam, or the like. Further, existing forming and creation methods of such pieces limit specific shapes, sizes, or features, leading to limited usability and full function.

Accordingly, a packaging piece for a dishwasher appliance which obviates one or more of the above-mentioned drawbacks would be beneficial. In particular, a molded pulp rack packaging piece would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance is provided. The dishwasher appliance may include a tub defining a receiving chamber; at least one rack assembly removably positioned within the receiving chamber, the at least one rack assembly including a wire frame member; and a rack piece removably coupled to the at least one rack assembly. The rack piece may include a first arm positioned along a first lateral side of the at least one rack assembly; and a second arm positioned along a second lateral side of the at least one rack assembly opposite the first lateral side, wherein the rack piece is formed from a recyclable molded pulp material.

In another exemplary aspect of the present disclosure, a rack piece for a dishwasher appliance is provided. The dishwasher appliance may include at least one rack assembly removably installed within a tub. The rack piece may include a first arm positioned along a first lateral side of the at least one rack assembly; and a second arm positioned along a second lateral side of the at least one rack assembly opposite the first lateral side, wherein the rack piece is formed from a recyclable molded pulp material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
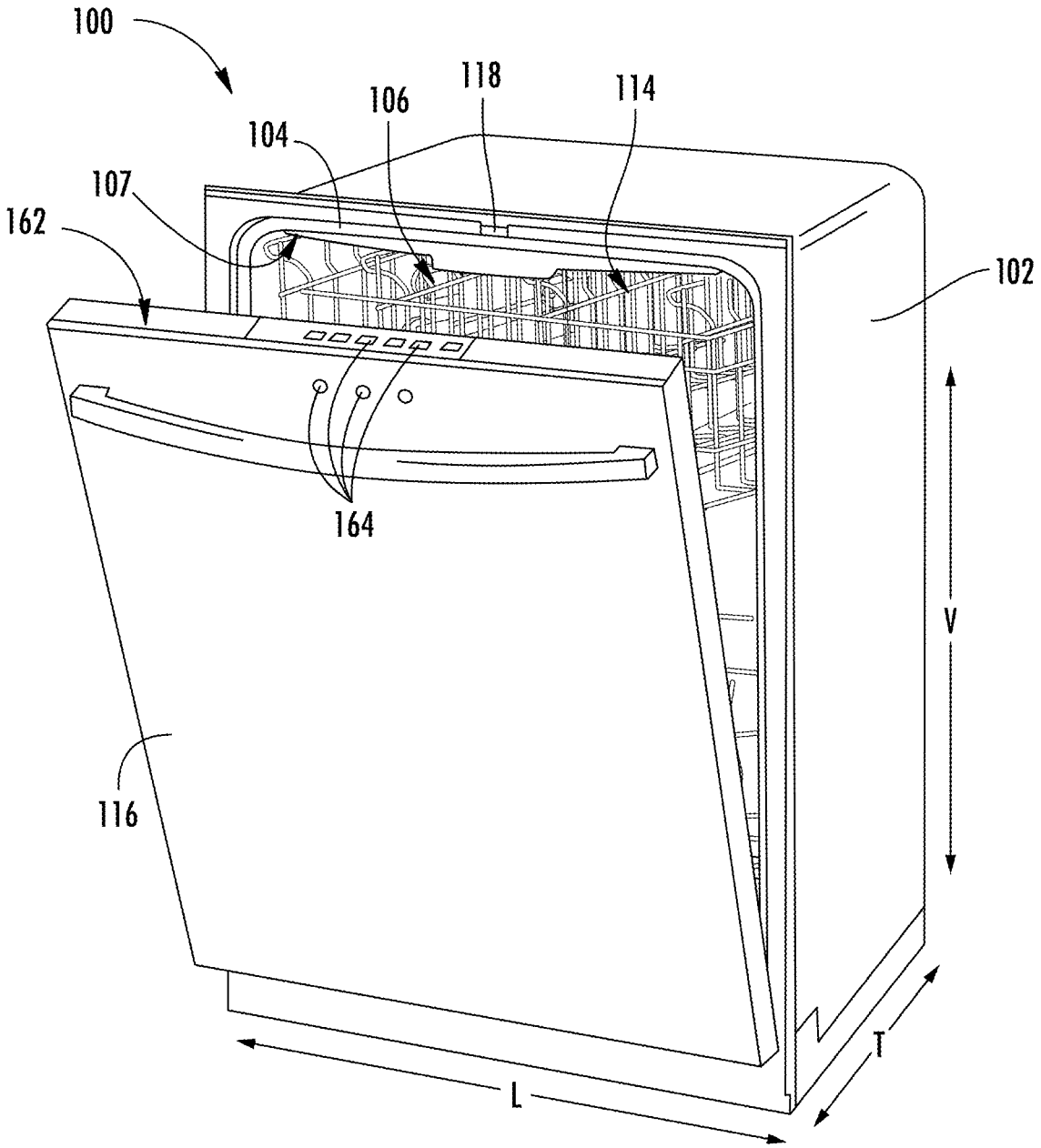
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
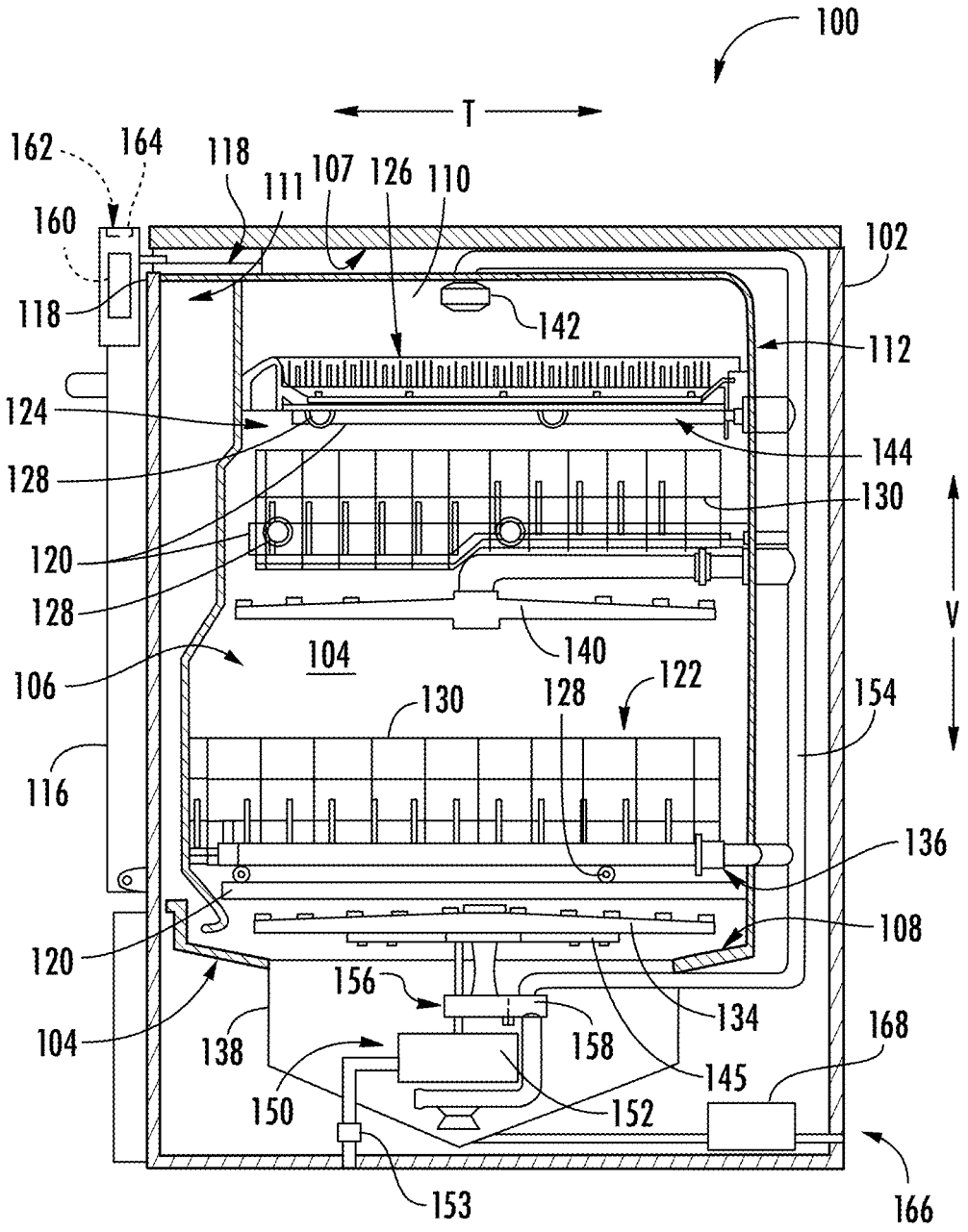
FIG. 2 provides a side, cross-sectional view of the exemplary dishwashing appliance of FIG. 1.

Turning now to the figures, FIGS. 1 and 2 depict an exemplary dishwasher or dishwasher appliance (e.g., dishwasher appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 may include a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 may include a front opening 114 (FIG. 1). In some embodiments, dishwasher appliance 100 may also include a door 116 at the front opening 114. Door 116 may, for example, be hinged at its bottom for movement between a normally closed vertical position, wherein wash chamber 106 is sealed shut for washing operations, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (FIG. 5) may be removably attached to a rack assembly (e.g., lower rack assembly 122), for placement of silverware, utensils, and the like, that are otherwise too small to be accommodated by the rack assembly.

Generally, dishwasher 100 may include one or more spray assemblies for urging a flow of fluid (e.g., wash liquid) onto the articles placed within wash chamber 106. In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210 (e.g., FIG. 4). For instance, filter clean spray assembly 145 may be directed downward to urge a flow of wash liquid across a portion of filter assembly 210 (FIG. 4) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 may be positioned between the external water supply line and circulation pump 152 (e.g., to selectively allow water to flow from the external water supply line to circulation pump 152). Additionally or alternatively, water inlet valve 153 may be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134 and 140, upper spray assembly 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits-only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

Figure 3:
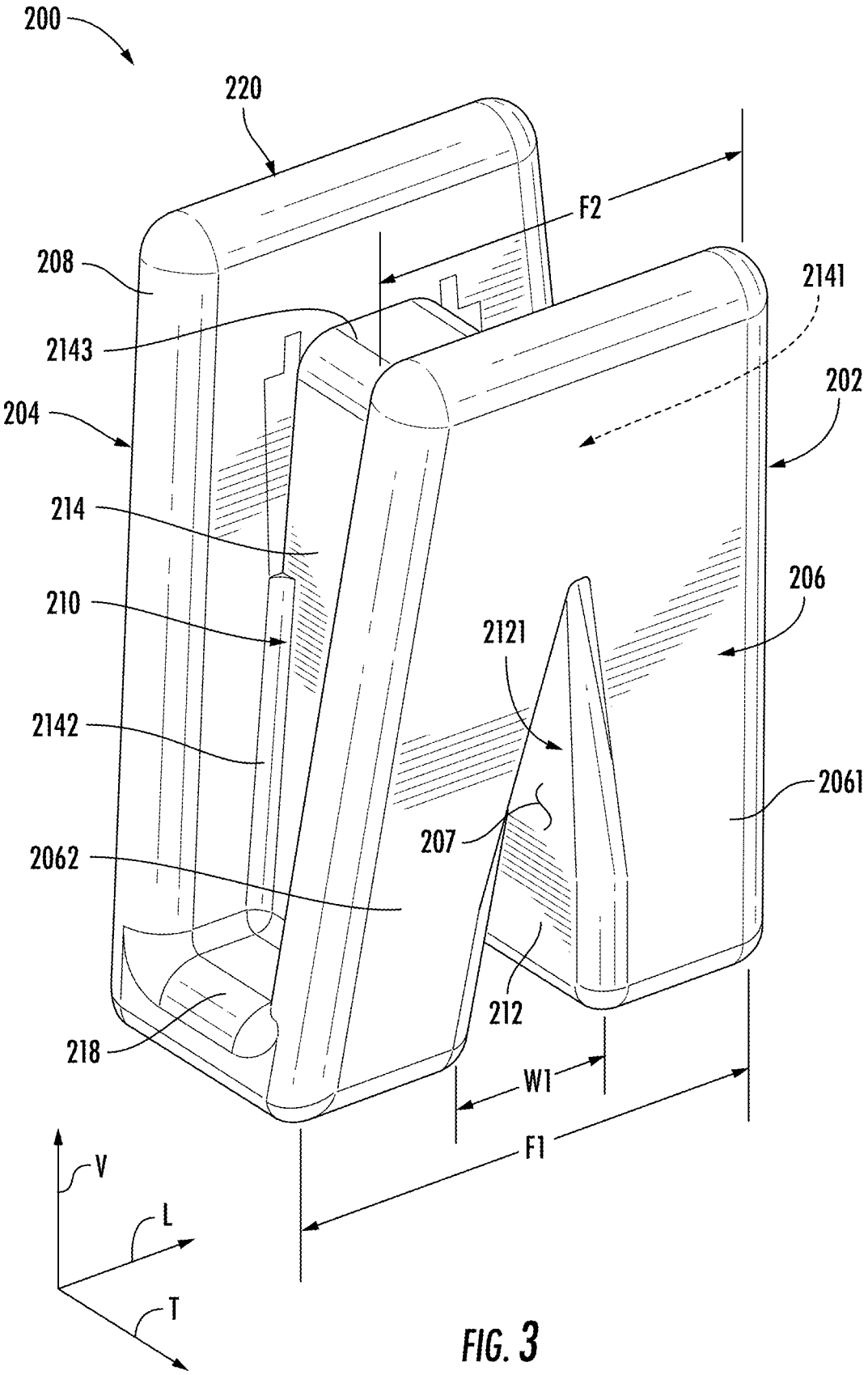
FIG. 3 provides a perspective view of a packaging piece for a dishwasher appliance according to exemplary embodiments of the present disclosure.
Figure 4:
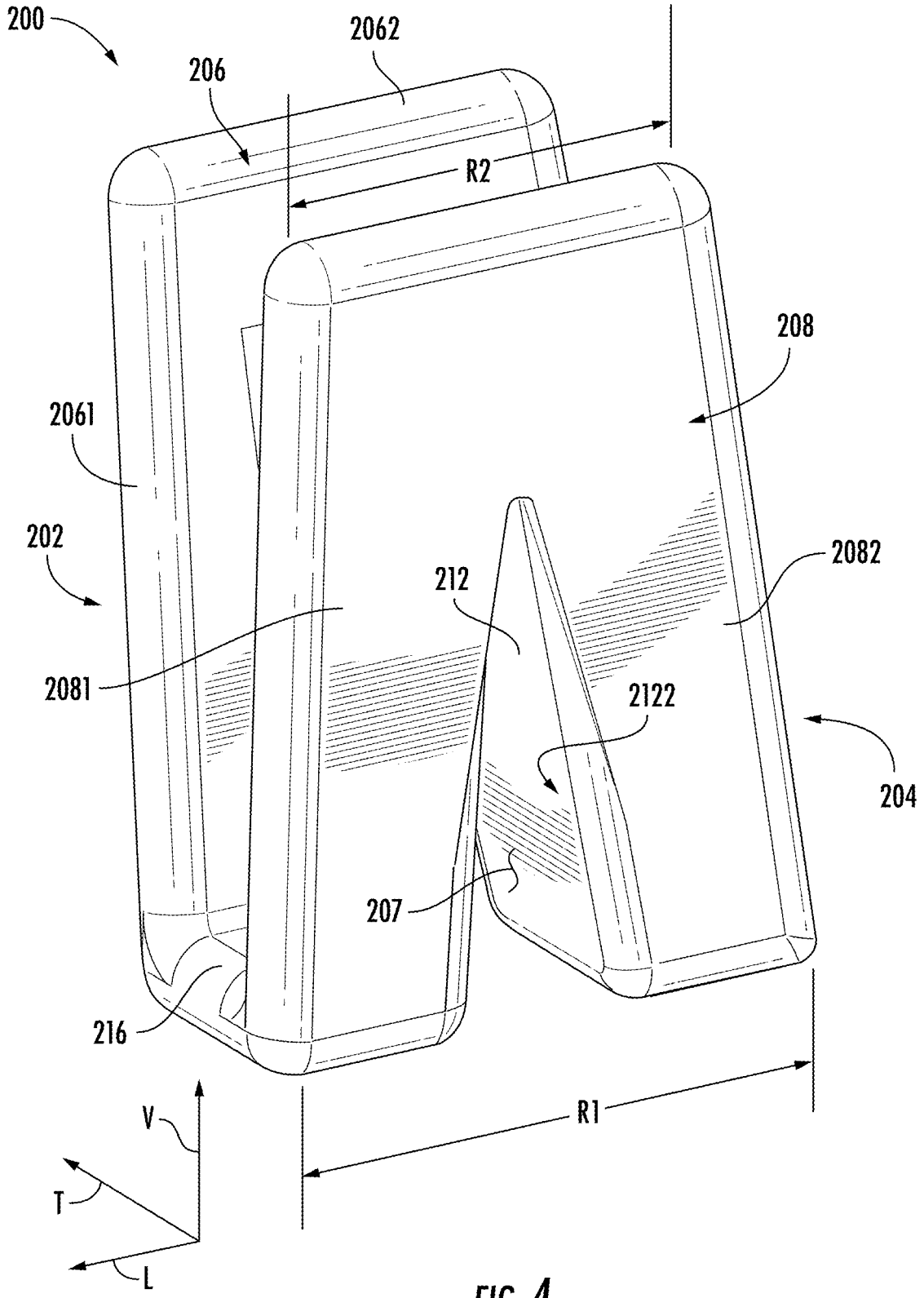
FIG. 4 provides a perspective view of the exemplary packaging piece of FIG. 3.
Figure 5:
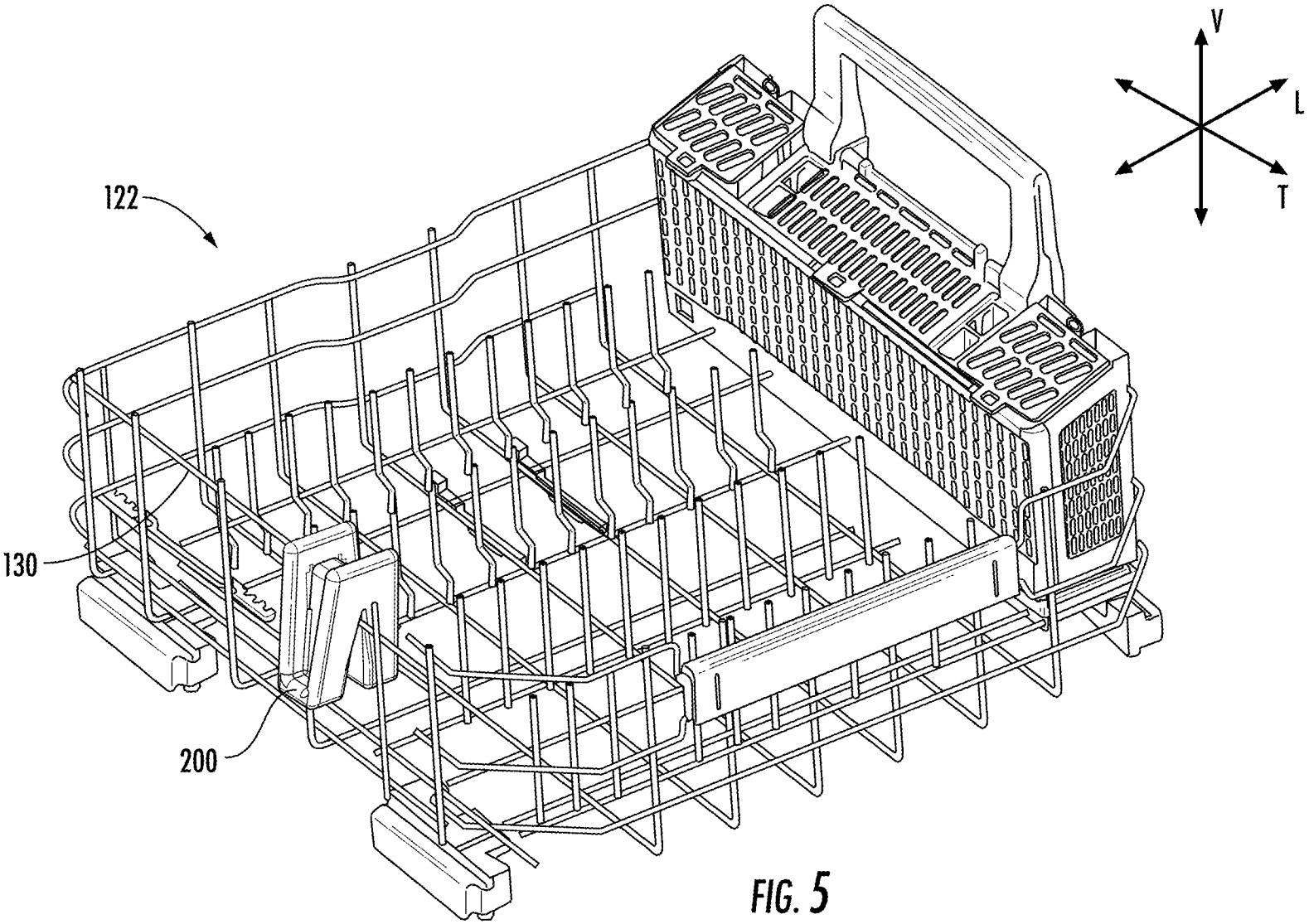
FIG. 5 provides a perspective view of a washing rack of a dishwasher appliance including the exemplary packaging piece of FIG. 3.

Referring now to FIGS. 3 through 5, an exemplary packaging piece will be described in detail. Dishwasher 100 may include one or more packaging materials which secure pieces (e.g., rack assemblies 122, 124, 126) during packing and transport. The packaging materials may include a rack piece 200. For instance, rack piece 200 may be attached to at least one rack assembly (e.g., lower rack assembly 122) at assembly for securing the at least one rack assembly for transit. In some embodiments, rack piece 200 is placed over a top or upper tine (e.g., wire, elongated member, etc.) of lower rack assembly 122 between the rack and side wall 110 of tub 104 (e.g., within wash chamber 106). For the sake of brevity hereinafter, rack piece 200 will be described with reference to an installation on lower rack assembly 122 with the understanding that rack piece 200 may be attached to, installed at, or otherwise placed on any suitable item or element (e.g., such as middle rack assembly 124, upper rack assembly 126, etc.).

Rack piece 200 may be formed from a molded pulp material. In detail, molded pulp may include one or more recycled or recyclable materials, such as recycled paperboard, newsprint, paper packaging, cardboard, or the like. Rack piece 200 may include thick-walled molded, or slush molded pulp material capable of providing rigidity and maintaining shape through minor force applied thereto. In additional or alternative embodiments, rack piece 200 include thin-walled molded pulp, including two or more layers of thin-walled molded pulp to form a single rack piece 200. However, it should be understood that the disclosure is not limited to the examples provided herein, and rack piece may include thermoformed fiber molded pulp, processed molded pulp, any combination of two or more forms of molded pulp, or the like.

Rack piece 200 may have a partial hyperbolic paraboloid surface contour. For instance, rack piece 200 may include a first arm 202 and a second arm 204. First arm 202 may be selectively positioned at a first lateral side of the upper tine of lower rack assembly 122. Accordingly, second arm 204 may be selectively positioned at a second lateral side of the upper tine of lower rack assembly 122. Thus, rack piece 200 may straddle a side wall or side lattice (e.g., an upper tine) of lower rack assembly 122 in an installed position. First arm 202 and second arm 204 may be joined, connected, or otherwise meshed along a central plane (e.g., along the lateral direction L) of rack piece 200. As mentioned above, rack piece 200 may be formed as a single unitary molded piece (e.g., molded pulp), and as such, first arm 202 and second arm 204 may be defined as extensions along the vertical direction V.

Rack piece 200 may include a front panel 206. Front panel 206 may be defined predominantly along the vertical direction V and the lateral direction L. For instance, front panel 206 may generally have an A-frame shape (e.g., such as resembling an inverted "V"). Accordingly, front panel 206 may include a first lateral extension 2061 and a second lateral extension 2062. In detail, first lateral extension 2061 may form at least part of first arm 202 while second lateral extension 2062 forms at least part second arm 204. Moreover, front panel 206 may taper upward along the vertical direction V. For instance, a bottom width F1 of front panel 206 at a bottom edge thereof may be greater than a top width F2 of front panel 206 at a top edge thereof. According to some embodiments, top width F2 is between about 70% and about 90% of bottom width F1. However, it should be noted that the dimensions given herein are provided by way of example only, and that any suitable dimensions or measurements may be incorporated into specific embodiments.

A gap or space 207 may thus be defined between first lateral extension 2061 and second lateral extension 2062 (e.g., along the lateral direction L) at a bottom portion of front panel 206. According to some embodiments, a height H1 of gap 207 (e.g., along the vertical direction V) may be between about 60% and about 80% of a total height H2 of front panel 206. Additionally or alternatively, a width of gap 207 (e.g., along the lateral direction L) may vary along the height thereof. For instance, a bottom width W1 of gap 207 at a bottom thereof may be greater than a top width of gap 207 at a top thereof. In some instances, the top width of gap 207 is approximately zero. Thus, gap 207 may taper upward along the vertical direction V. Further, gap 207 may extend along the transverse direction T through rack piece 200.

Rack piece 200 may include a rear panel 208. Rear panel 208 may be defined predominantly along the vertical direction V and the lateral direction L. Similar to front panel 206, rear panel 208 may generally have an A-frame shape (e.g., such as resembling an inverted "V"). Accordingly, rear panel 208 may include a first lateral extension 2081 and a second lateral extension 2082. In detail, first lateral extension 2081 may form at least part of first arm 202 while second lateral extension 2082 forms at least part second arm 204. Moreover, rear panel 208 may taper upward along the vertical direction V. For instance, a bottom width R1 of rear panel 208 at a bottom edge thereof may be greater than a top width R2 of rear panel 208 at a top edge thereof. According to some embodiments, top width R2 is between about 70% and about 90% of bottom width R1. However, it should be noted that the dimensions given herein are provided by way of example only, and that any suitable dimensions or measurements may be incorporated into specific embodiments. Rear panel 208 may thus be substantially similar to front panel 206, such that rear panel 208 mirrors front panel 206 along the transverse direction T.

Rack piece 200 may include a connecting panel 210. Connecting panel 210 may connect front panel 206 with rear panel 208. For instance, connecting panel 210 may extend predominantly along the transverse direction T between front panel 206 and rear panel 208. Connecting panel 210 may thus extend or protrude from an inner edge of each of front panel 206 and rear panel 208 along the transverse direction T (e.g., at gap 207). Connecting panel 210 may include a resting face 212 and a saddle face 214. Resting face 212 may be opposite saddle face 214. For instance, resting face 212 may form a portion of gap 207 between front panel 206 and rear panel 208, and between first arm 202 and second arm 204. When rack piece 200 is in the installed position (e.g., on lower rack assembly 122), resting face 212 may be in contact with lower rack assembly 122 (e.g., the upper tine or wire frame member thereof).

As mentioned, saddle face 214 may be opposite resting face 212. Saddle face may include a first lateral portion 2141 facing a first lateral direction between front panel 206 and rear panel 208, a second lateral portion 2142 facing a second lateral direction between front panel 206 and rear panel 208, and a top portion 2143 facing upward along the vertical direction V between front panel 206 and rear panel 208. According to some embodiments, and as shown in FIGS. 3 and 4, saddle face 214 is recessed inward from outer edges of each of front panel 206 and rear panel 208 (e.g., along the lateral direction L and the vertical direction V).

Resting face 212 may include a first resting face 2121 and a second resting face 2122. First resting face 2121 may be provided or defined at a first lateral side thereof while second resting face 2122 is provided or defined at a second lateral side thereof. For instance, first resting face 2121 may form or define a first lateral interior side of first arm 202. Similarly, second resting face 2122 may form or define a second lateral interior side of second arm 204. Gap 207 may thus be defined between first resting face 2121 and second resting face 2122. Additionally or alternatively, first resting face 2121 and second resting face 2122 may be nonparallel with each other. For instance, first resting face 2121 and second resting face 2122 may intersect at the top of gap 207. According to at least some embodiments, an angle between first resting face 2121 and second resting face 2122 may be between about 5 degrees and about 15 degrees.

Connecting panel 210 may include a first foot 216 and a second foot 218. First foot 216 may extend along the transverse direction T at a base (e.g., bottom) of rack piece 200. For instance, first foot 216 may extend between front panel 206 and rear panel 208 along the transverse direction T. First foot 216 may be positioned at a first lateral side of rack piece 200. Additionally or alternatively, first foot 216 may extend along the lateral direction L from a base of saddle face 214 outward. Similarly, second foot 218 may extend along the transverse direction T at the base (e.g., bottom) of rack piece 200. For instance, second foot 218 may extend between front panel 206 and rear panel 208 along the transverse direction T. Second foot 218 may be positioned at a second lateral side of rack piece 200. Additionally or alternatively, second foot 218 may extend along the lateral direction L from a base of saddle face 214 outward (e.g., opposite first foot 216).

According to some embodiments, rack piece 200 may include a coating 220. Coating 220 may be applied to rack piece 200 after a formation thereof. As mentioned, rack piece 200 may be formed from a recyclable molded pulp material (e.g., through shaping, compressing, etc.). Once the general shape of rack piece 200 is defined, rack piece 200 may be provided with coating 220 (e.g., by dipping, painting, spraying, or the like). Coating 220 may include a wax coating. Advantageously, rack piece 200 may be waterproofed before being installed to lower rack assembly 122 (or any other portion or member within appliance 100).

According to some embodiments, rack piece 200 includes a hinge. The hinge may couple, for instance, front panel 206 (or rear panel 208, or both) to a locking tab. The hinge may include a living hinge. For instance, the locking tab may be formed as part of rack piece 200 that is at least partially elastic. Thus, the locking tab may selectively deform with respect to rack piece 200 to allow rack piece 200 to be securely attached to, e.g., lower rack assembly 122.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a tub defining a receiving chamber;

at least one rack assembly removably positioned within the receiving chamber, the at least one rack assembly comprising a wire frame member; and a rack piece removably coupled to the at least one rack assembly, the rack piece comprising:

a first arm positioned along a first lateral side of the at least one rack assembly;

a second arm positioned along a second lateral side of the at least one rack assembly opposite the first lateral side;

a front panel;

a rear panel opposite the front panel along the transverse direction; and a connecting panel connecting the front panel with the rear panel, the connecting panel comprising:

a resting face comprising a first resting face at a first lateral side thereof and a second resting face at a second lateral side thereof, wherein the first lateral side and the second lateral side are nonparallel and define an angle therebetween; and a saddle face recessed inward from outer edges of the front panel and rear panel, wherein the rack piece is formed from a recyclable molded pulp material.

2. The dishwasher appliance of claim 1, wherein the angle between the first resting face and the second resting face is between 5 degrees and 15 degrees.

3. The dishwasher appliance of claim 1, wherein the wire frame member is in contact with the resting face when the rack piece is in an installed position.

4. The dishwasher appliance of claim 1, wherein the connecting panel further comprises:

a first foot extending along the transverse direction at a base of the rack piece; and a second foot extending along the transverse direction at the base of the rack piece opposite the first foot.

5. The dishwasher appliance of claim 4, wherein each of the first foot and the second foot connect the front panel to the rear panel.

6. The dishwasher appliance of claim 1, wherein the rack piece further comprises a wax coating applied after formation of the rack piece for waterproofing.

7. A rack piece for a dishwasher appliance, the dishwasher appliance defining a vertical direction, a lateral direction, and a transverse direction and comprising at least one rack assembly removably installed within a tub, the rack piece comprising:

a first arm positioned along a first lateral side of the at least one rack assembly;

a second arm positioned along a second lateral side of the at least one rack assembly opposite the first lateral side;

a front panel;

a rear panel opposite the front panel along the transverse direction; and a connecting panel connecting the front panel with the rear panel, the connecting panel comprising:

a resting face comprising a first resting face at a first lateral side thereof and a second resting face at a second lateral side thereof, wherein the first lateral side and the second lateral side are nonparallel and define an angle therebetween; and a saddle face recessed inward from outer edges of the front panel and rear panel, wherein the rack piece is formed from a recyclable molded pulp material.

8. The rack piece of claim 7, wherein the angle between the first resting face and the second resting face is between 5 degrees and 15 degrees.

9. The rack piece of claim 7, wherein the at least one rack assembly comprises a wire frame member, and wherein the wire frame member is in contact with the resting face when the rack piece is in an installed position.

10. The rack piece of claim 7, wherein the connecting panel further comprises:

a first foot extending along the transverse direction at a base of the rack piece; and a second foot extending along the transverse direction at the base of the rack piece opposite the first foot.

11. The rack piece of claim 10, wherein each of the first foot and the second foot connect the front panel to the rear panel.

12. The rack piece of claim 7, wherein the rack piece further comprises a wax coating applied after formation of the rack piece for waterproofing.

* * * * *